US005448346A

United States Patent [19]

Tabata

[11] Patent Number: 5,448,346

[45] Date of Patent: Sep. 5, 1995

[54] IMAGE RECORDING APPARATUS AND METHOD INCLUDING IMAGE SIZE RECOGNITION AND CENTERING OF THE REPRODUCED IMAGE

[75] Inventor: Yasuhiro Tabata, Kawasaki, Japan

[73] Assignee: Ricoh Company, Ltd., Tokyo, Japan

[21] Appl. No.: 214,209

[22] Filed: Mar. 17, 1994

[30] Foreign Application Priority Data

Mar. 17, 1993 [JP] Japan ..... 5-082576

[51] Int. Cl.[6] ..... G03G 15/041

[52] U.S. Cl. ..... 355/311; 355/313; 358/449; 358/452

[58] Field of Search ..... 355/311, 313, 208, 55, 355/56, 75; 358/448, 449, 451, 452

[56] References Cited

U.S. PATENT DOCUMENTS 4,788,599 11/1988 Sugishima ..... 358/295
4,816,867 3/1989 Ito .
4,941,017 7/1990 Mishima et al. ..... 355/218
5,001,574 3/1991 Shimizu ..... 358/448
5,049,932 9/1991 Sumida ..... 355/55 X

OTHER PUBLICATIONS

Patent Abstracts of Japan, JP 1-219852, Sep. 1, 1989.
Patent Abstracts of Japan, JP 63-179662, Jul. 23, 1988.

*Primary Examiner*—R. L. Moses
*Attorney, Agent, or Firm*—Oblon, Spivak, McClelland, Maier, & Neustadt

[57] ABSTRACT

An image recording apparatus which provides a size detector or size recognition, such that the size of an image to be recorded is determined, and the recorded image can thereby be centered on the recording paper or sheet upon which the image is to be formed. The apparatus and method can automatically determine a longitudinal length and transverse length of an image (e.g., in a copier or printer) and does not require operator input for size recognition. The apparatus can additionally, or alternatively recognize an image direction, with the direction recognition utilized in placing the reproduced image on a sheet of paper.

20 Claims, 6 Drawing Sheets

IMAGE RECORDING APPARATUS AND METHOD INCLUDING IMAGE SIZE RECOGNITION AND CENTERING OF THE REPRODUCED IMAGE

FIELD OF THE INVENTION

This invention relates to an image recording apparatus, such as an electrophotographic apparatus, a laser printer, and a facsimile machine.

BACKGROUND OF THE INVENTION

In office environment, there exists many different sizes of document, and the documents are generally complied into files or books, which are stored in a desk or a cabinet.

Although private companies tend to use papers of sizes A4 or A3, government and municipal offices generally use papers of size B in a relatively large number according to regulations. As a result, there exists in many offices a mixture of papers of sizes A and B, causing a huge problem in storing and managing documents.

Due to these inconveniences, there is an ongoing plan by administration offices to unify the size of documents, so that any newly drawn documents will be standardized into unified sizes based on a new rule.

However, when copying, already written original documents that have been stored in size B (for example B5) with a copier, it would still end up being copied on recording paper of size B5. Unless the documents are photocopied in enlargement or reduction.

On the other hand, there are some copiers that have the ability to distinguish the sizes of the documents, and automatically feed the right size of the paper from the paper feed cassette; however, it is difficult to perfectly copy to recording paper having a standard size, for example A4. Also, in case of the copiers without this kind of ability, but with a plurality of paper feed cassette for recording paper of varieties of sizes, the users are apt to select recording paper having the same size as the original documents, which makes it difficult to make copies on recording paper of a unified size.

Therefore, in order to surely standardize the size of papers in offices, it is necessary to use a copier which could only install the specified size of the paper.

Conventional types of copiers that can automatically unify the sizes of recording papers include, for instance, the "Size unification apparatus in digital copier" disclosed in Japanese Patent Laid-Open Publication No. 179662/1988, and the "Copying apparatus" disclosed in Japanese Patent Laid-Open Publication No. 219852/1989.

Assuming that there exists a copier in which only a unified (A4) size of recording paper can be set, if a manuscript of size B5 is put on a manuscript stand and copied as usual in size A4 paper using this type of copier, the image would be recorded on the A4 paper, but copying is executed according to a positioning sequence for copying a B5 size manuscript on B5 size recording paper, and for this reason, the image is not copied at a correct position on the recording paper.

In a case where a reference position for positioning a manuscript is provided at an edge of a manuscript stand (contact glass) as shown in FIG. 9A, if a size B5 manuscript 902 is placed for copying on a manuscript stand 901, an image 904 (an image of the size B5 manuscript) is recorded on size A4 recording paper 903 as shown in FIG. 9B, so that layout of the image 904 against the recording paper 903 is not balanced.

Also, as in FIG. 10A, where a marker is positioned in the center of a corner of the manuscript stand, if a size B5 paper 1002 is placed on the stand 1001, an image 1004 (image of size B5 manuscript) is recorded on size A4 recording paper 1003. In this case, the appearance is better as compared to that shown in FIG. 9B, but still layout of the image 1004 against the recording paper 103 is not balanced.

If a user decides to recopy the documents after altering their positions on the manuscript stand, it would cause a waste of sources and time.

On the other hand, if a user decides to use the copying apparatus disclosed in Japanese Patent Laid-Open Publication 179662/1988 or 219852/1989, no matter what size of paper the document is, one would be able to copy on the unified size of papers; however, there are disadvantages caused by enlargement/reduction of images that are done automatically by the apparatus above, for example, the image information would be altered as a result of changed sizes of letters.

SUMMARY OF THE INVENTION

It is an object of the present invention to unify the size of the recording papers to a prespecified one, and/or to set and record the images needed in a suitable layout.

In order to accomplish the above described objects, the present invention provides an image recording apparatus: an image size recognizing means which recognizes the size of the image that needs to be recorded, a paper feeding means which stores and feeds recording papers of determined size, an image forming means which forms an image on a recording paper fed from the paper feeding means, an image processing means which processes an image so that a center of the image that needs to be recorded and a center of the recording paper are in accordance with each other based on the recognizing result of the image size recognizing means, and an image outputting means which outputs an image processed by the image processing means to the image forming means.

In addition to the structures stated above, the present device should preferably includes an image direction recognizing means which recognizes a direction of the image that needs to be recorded, and execute image processing based on the information taken from the image size recognizing means and the image direction recognizing means. Also, the image processing means described above should preferably include a function which changes vertical side to transverse side and vice versa.

Likewise, in addition to the structures described above, the present device should preferably include an image inclination recognizing means which recognizes an inclination of the image that needs to be recorded, and execute image processing to adjust the inclination of a recording paper to the inclination of the image that needs to be recorded, based on the inclination of the image measured by the image inclination recognizing means.

Furthermore, in order to accomplish the above described objects, the present invention provides an image recording apparatus comprising, in addition to the structures stated above, an image size/direction recognizing means which recognizes the size and the direction of an image that needs to be recorded, a first paper feeding means which stores and feeds a recording paper of designated size in the vertical direction, a second paper feeding means which stores and feeds a recording paper of designated size in the transverse direction, a fed paper selecting means which selects the first or the second paper feeding means storing recording paper in the same direction as that of an image, according to the direction of the image detected by the image size/direction recognizing means, an image forming means which forms an image on the fed recording paper, based on the result of detection by the image size/direction recognizing means, an image processing means which processes an image so that a center of the image that needs to recorded and a center of the image that needs to recorded and a center of the recording paper are in accordance with each other, and an image outputting means which outputs the image processed by the image processing means to the image forming means. It should be noted that said image processing means should preferably have a function that changes the vertical side and the transverse side and vise versa in case that there is no recording paper in the same direction as the image.

In order to further accomplish the above described objects, the present invention provides an image recording apparatus comprising a document base on which a document is placed, an image reading means which optically reads a manuscript, an image size detecting means which detects a size of a manuscript picture read by the image reading means, a paper feeding means which stores and feeds recording paper of designated size, an image forming means which forms an image on the recording paper fed by the paper feeding means, an image processing means which processes an image so that a center of the image that needs to be recorded and a center of the recording paper are in accordance with each other based on the detecting result of the image size detecting means, and an image outputting means which outputs the image processed by the image processing means to the image forming process.

Furthermore, in order to accomplish the above described objects, the present invention provides an image recording means comprising an image size recognizing means which recognizes a size of the image that needs to be recorded, a paper feeding means which stores and feeds a recording paper of designated size, an image forming means which forms an image on a recording paper fed by paper feeding means, a controlling means which controls a feeding of two consecutive recording papers (means) in case that the result of image size recognizing means is greater in size than the recording paper, an image processing means which divides the image that needs to be recorded, in half, in the vertical direction, and processes setting a center of the image that needs to be recorded and a center of the recording paper are in accordance with each other again, in case that the result of image size recognizing means is greater in size than the recording paper, and an image processing means, which outputs the image processed by the image processing means to the image forming means.

Furthermore, in order to accomplish the above described objects, the present invention provides an image recording apparatus comprising a document base on which a document should be placed, an image reading means which optically reads a manuscript, an image size detecting means which detects a size of an image of the manuscript read by the image reading means, a paper feeding means which stores and feeds a recording paper of designated size, an image forming means forms which forms an image on the recording paper fed by the paper feeding means, a size variation setting means which sets a mode of enlargement or reduction of a document based on the result of the image size detection means, a first image processing means which processes the image so that a center of the image that needs to be recorded and a center of the recording paper are in accordance based on the size variation setting means, a second image processing means which performs an enlargement or reduction onto the recording paper, and an image outputting means which outputs the image processed by the first and/or the second image processing means to the image forming means.

It should be noted that the above described size variation setting means should preferably set the maximum size of enlargement to size A4. Likewise, there should preferably be a fed paper selecting means which selects the same direction of the recording paper as of the document, when the enlargement mode is selected by means of size variation setting means. Likewise, a size variation means should preferably be set the minimum size of reduction mode to size A4. Furthermore, in case of selecting the reduction mode by means of size variation selecting means, there should preferably be a fed paper selecting means that selects a recording paper of size A4 vertical.

The image recording apparatus according to the present invention recognizes a size of the image that needs to be recorded, processes an image so that a center of the image that needs to recorded and a center of the recording paper are in accordance with each other, and finally formats an image on the recording paper.

Furthermore, the image recording apparatus according to the present invention recognizes a size and a direction of the image that needs to be recorded, feeds a recording paper from the paper feeding means that stores the recording papers of the same direction as of the image, processes an image so that a center of the image that needs to recorded and a center of the recording paper are in accordance with each other, and finally formats an image on the recording paper.

Furthermore, the image recording apparatus according to the present invention optically reads a document that is set on a document base, by detecting a size of an image of the document read and based on the size of each document, processes an image so that a center of the image that needs to recorded and a center of the recording paper are in accordance with each other, and finally formats an image on the recording paper.

Furthermore, the image recording apparatus according to the present invention recognizes a size of the image that needs to be recorded, in case in which the image recognized is greater in size than a recording paper, sets the paper feeding means to feed two consecutive recording papers, and divides in half the image that needs to be recorded, in the longitudinal direction, furthermore, processes an image so that a center of the image that needs to recorded and a center of the recording paper are in accordance with each other, and finally formats an image on the recording paper.

Furthermore, the image recording apparatus according to the present invention optically reads a document that is set on a document base, by detecting a size of the image of the document read, processes an image so that a center of the image that needs to recorded and a center of the recording paper are in accordance with each other, moreover, performs enlargement or reduction onto the image that needs to be recorded according to instruction of enlargement or reduction from the size variation setting means, and finally formats an image on the recording paper.

As described above, the image recording apparatus according to the present invention recognizes the size of an image that needs to be recorded, processes the image so that a center of the image that needs to be recorded and a center of the recording paper are approximately in accordance with each other, and then forms an image on the recording paper. Therefore, a recording paper can, in advance, be unified into one size, and also, the designated image can be placed in an adequate layout and be recorded.

Furthermore, the image recording apparatus according to the present invention recognizes the size and the direction of an image that needs to be recorded, feeds a recording paper from a paper feeding means which stores a recording paper of the same direction as of the image, processes the image that a center of the image that needs to be recorded and a center of the recording paper are approximately in accordance with each other, and then forms an image on the recording paper. Therefore, a recording paper can, in advance, be unified into one size, and also, the designated image can be placed in an adequate layout and be recorded.

Furthermore, the image recording apparatus according to the present invention optically reads a document that is placed on a document base, detects the size of an image that has been read, based on the size of an image of each document, processes the image that a center of the image that needs to be recorded and a center of the recording paper are approximately in accordance with each other, and then forms an image on the recording paper. Therefore, a recording paper can, in advance, be unified into one size, and also, the designated image can be placed in an adequate layout and be recorded.

Furthermore, the image recording apparatus according to the present invention recognizes the size and the direction of an image that needs to be recorded, in a case in which the size of an image that has been recognized is greater than a recording paper, controls feeding so that two recording papers are fed consecutively by the paper feeding means, longitudinally separate the image that needs to be recorded, in half, processes the image that a center of the image that needs to be recorded and a center of the recording paper are approximately in accordance with each other, and then forms an image on the recording paper. Therefore, a recording paper can, in advance, be unified into one size, and also, the designated image can be placed in an adequate layout and be recorded.

Furthermore, the image recording apparatus according to the present invention optically reads a document that is placed on a document base, detects the size of an image of a document that has been read, processes the image that a center of the image that needs to be recorded and a center of the recording paper are approximately in accordance with each other, based on the enlargement/reduction set by a magnification setting means, performs enlargement or reduction on the image that needs to be recorded, and then forms an image on the recording paper. Therefore, a recording paper can, in advance, be unified into one size, and also, the designated image can be placed in an adequate layout and be recorded.

Other objects and features of this invention will become understood from the following description with reference to the accompanying drawings.

DETAILED DESCRIPTION OF THE EMBODIMENTS

By using the example of a case in which the present invention is applied a copier, detailed description is made, in the following, for Embodiment 1, Embodiment 2 and Embodiment 3 in this sequence with related drawings.

Figure 1:
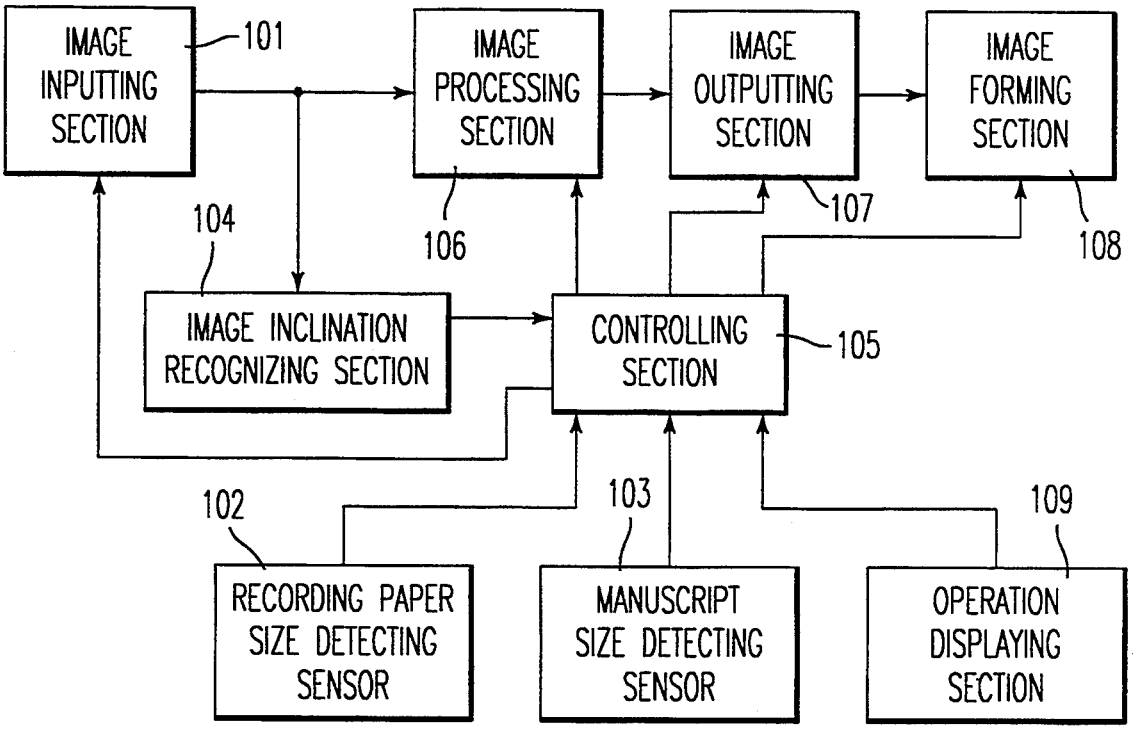
FIG. 1 is a block diagram of the copier (an image recording apparatus) according to the invention.

FIG. 1 is a block diagram of a copier according to embodiment 1, comprising an image inputting section 101 that optically reads a document, a recording paper size detecting sensor 102 that detects the size of a recording paper, a manuscript size detecting sensor 103 that detects the size of a manuscript, an image inclination recognizing section 104 that recognizes the inclination of the image of a document, a controlling section 105 that controls every part of the section, an image processing section 106 that performs the image processing according to the present invention (processing of an image for setting a center of the image that needs to recorded and a center of the recording paper in accordance with each other) as well as every image processing, an image outputting section 107 that outputs the image processed by the image processing section 106 to the image forming section 108 that forms an image on the recording paper, and an operation displaying section 109 that performs every key input as well as indicates every message.

Figure 2:
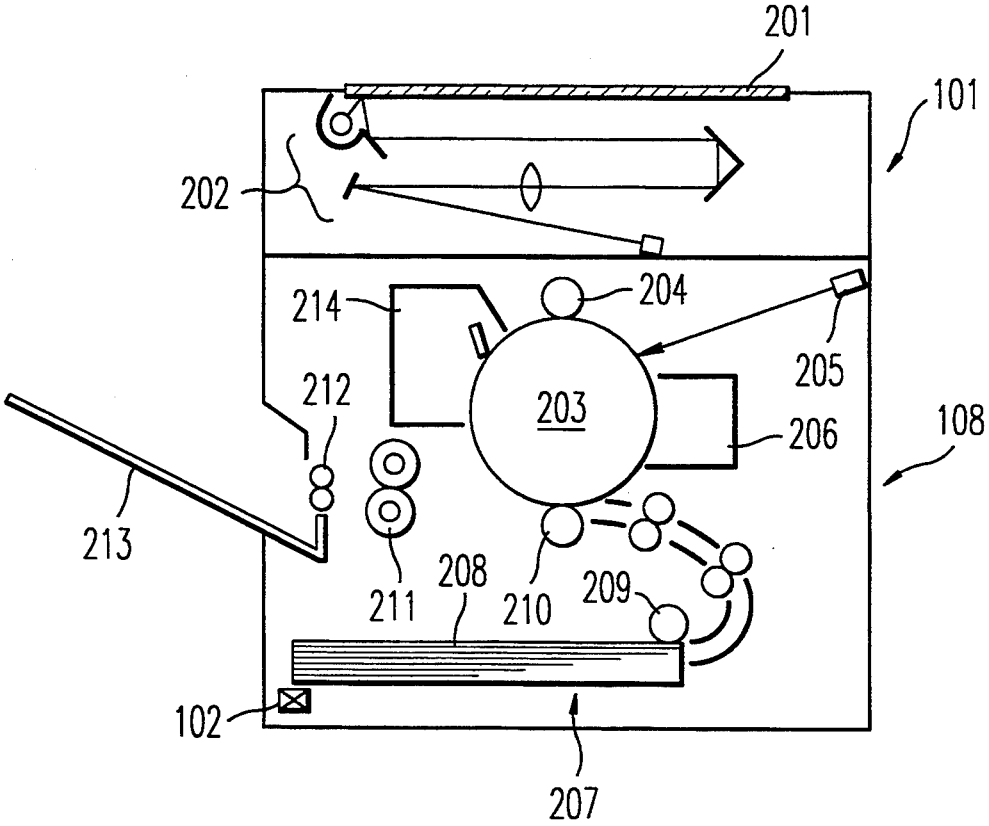
FIG. 2 is a schematic sectional diagram of the image inputting section and the image forming section.

FIG. 2 is a schematic sectional view showing an image inputting section 101 and an image forming section 108. A document that needs to be copied is placed on a document base 201, and the image of the document is optically read by a scanning optical system 202. During this scanning, the size of the document is detected by the above described manuscript size detecting sensor 103. A photo-sensitive drum 203 is uniformly charged by a charged unit 204, comprising rollers with voltage loaded thereto. An electrostatic latent image is formed on the photo-sensitive drum 203 as a result of a irradiation of a light image by a writing optical system 205 on the photo-sensitive drum 203.

Next, this latent image is visualized by a developing unit 206. Associating with the image formation on the photo-sensitive drum 203, a paper feeding unit 207 feeds recording paper. This paper feeding unit 207 is comprises a cassette 208 which stores size A4 recording papers, and a paper feeding roller 209 which feeds recording paper one by one. After the recording paper, fed by this paper feeding unit 207, is transferred to a transferring unit which is constiuted of a transferring roller 210, a toner image on the photo-sensitive drum 203 is transferred onto the recording paper. Continuously, after the recording paper is separated from the photo-sensitive drum 203, it goes through a fixing unit 211, where the toner image is fixed on the recording paper. The recording paper is discharged onto a discharging tray 213, outside the apparatus, by a discharging roller 212. Meanwhile, the untransferred residual toner on the post transferring photo-sensitive drum is removed by a cleaning unit 214. Thus, a copying cycle is terminated.

The operation of aforementioned construction will be described below. First, a case of copying of a size A4 document will be described. The size of a document which is placed on a document base 201 is detected, via a scanning optical system 202, by a manuscript size detecting sensor 103. A paper feeding device 207 stores the same size A4 recording paper, so that standard copying procedures are followed.

Next, a case of copying a size B5 document will be described. Like the above described example, the size of a document is detected as size B5 by the manuscript size detecting sensor 103. In this case, the controlling section 105 executes the following image processes. Since a document is set to B5 transverse, a difference between the centers of B5 transverse and A4 transverse is known in advance. The displacement, on the image is adjusted in the perpendicular direction from scanning direction, by the image processing section 106.

Figure 3:
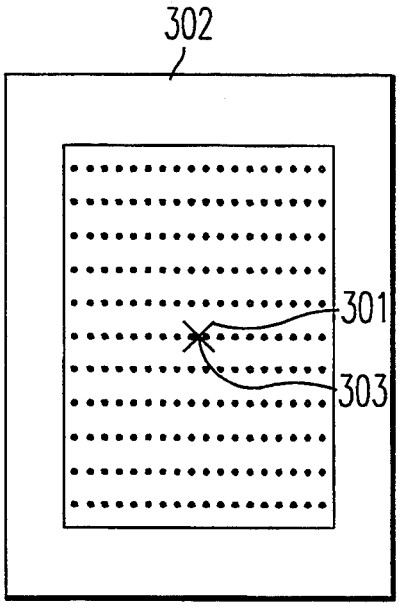
FIG. 3 is a diagram that explains positioning of the image according to the invention.

Likewise, given that displacement of scanning direction is known in advance, the controlling section 105 controls the image outputting section 107 by shifting the output timing of the image. Accordingly, the writing optical system 205 forms an image on the photo-sensitive drum 203, so that, as shown in FIG. 3, a center 301 of the document and a center 303 of the recording paper 302 can be in accordance. In such a manner, when copied with a size A4 exclusive copier, the image positioning can be adequately operated even with a size B5 document.

However, there is a possibility that a user might store a size B5 recording paper in the cassette 208, in which a size A4 recording paper should be stored, because it is physically possible for a size B5 recording paper to be stored in the cassette since a size B5 is smaller than a size A4. Therefore, in order to prevent the above described happening, the controlling section 105 stops the image forming operation itself, unless the paper in the cassette 208 is of the designated size (A4). This operation is made possible by a detecting signal detected by a recording paper size detecting sensor which detects the size of a recording paper that is stored in a cassette 208. Likewise, when a recording paper of inadequate size is set in the paper feeding unit 207, the controlling section 105 displays the information on an operating panel. Thus, a user can recognize the inadequate situation in advance.

Figure 4:
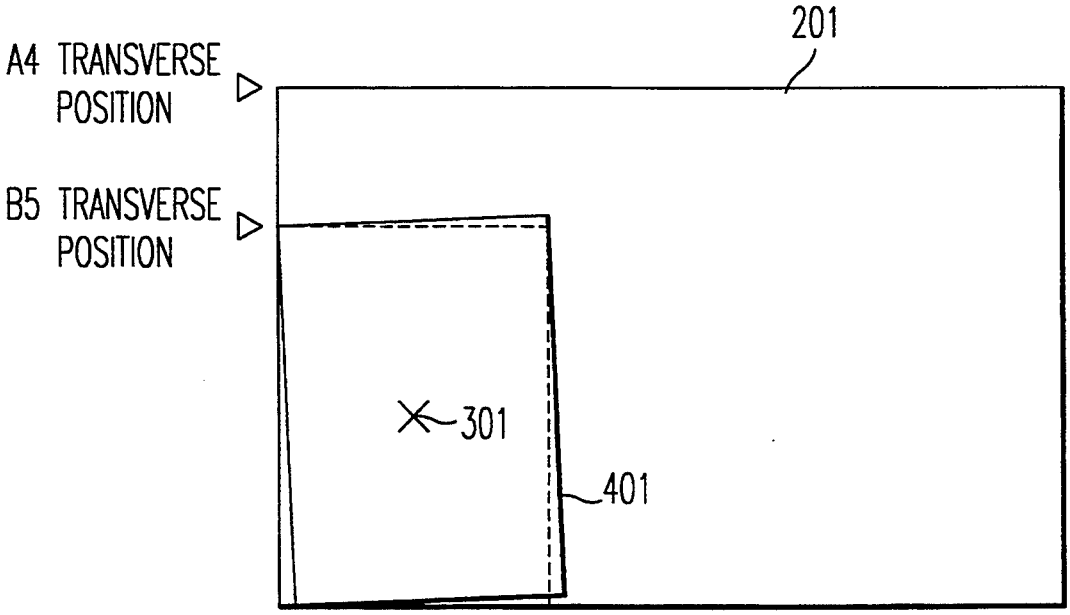
FIG. 4 is a diagram that explains the image processing according to the invention.

Furthermore, assuming that the center 301 of a document 401 is placed on the document base 201 correctly as shown in FIG. 4, sometimes it may be rotated counterclockwise. Even in such a case, the magnitude of the rotation of the document is recognized by the image inclination recognizing section 104 which grasps a direction of lettering alignments of read documents, or a state of the edge, vertical or transverse of a document. The result is input into a controlling section 105, and then the image is rotated in a calculated amount by an image processing section 106. Thereafter, via an image outputting section 107, an image is output by a writing optical system 205 in the image forming section 108 onto the photo-sensitive drum 203. As a result, not only the center of a document is in accordance, but also the inclination is adjusted, and the adequate image is formed on the recording paper.

The first embodiment explained a case where size B5 document is place in the traverse direction, namely, when the scanning direction of an optical system is place perpendicularly to the longitudinal direction of a document, but it is needless to say that also in a case in which a size B5 document is placed vertically, the document could be processed in the same exact manner. Therefore, no matter which direction a document is placed, if its size and its direction are recognized, the document can be image processed in accordance with the present arrangement.

In addition, if a document is set transversally, and a recording paper, in a paper feeding unit 207, is set vertically, then, it would be possible to output the image in accordance with the recording paper, if a vertical side and a transverse side of the image are switched by an image processing section 106.

Figure 5:
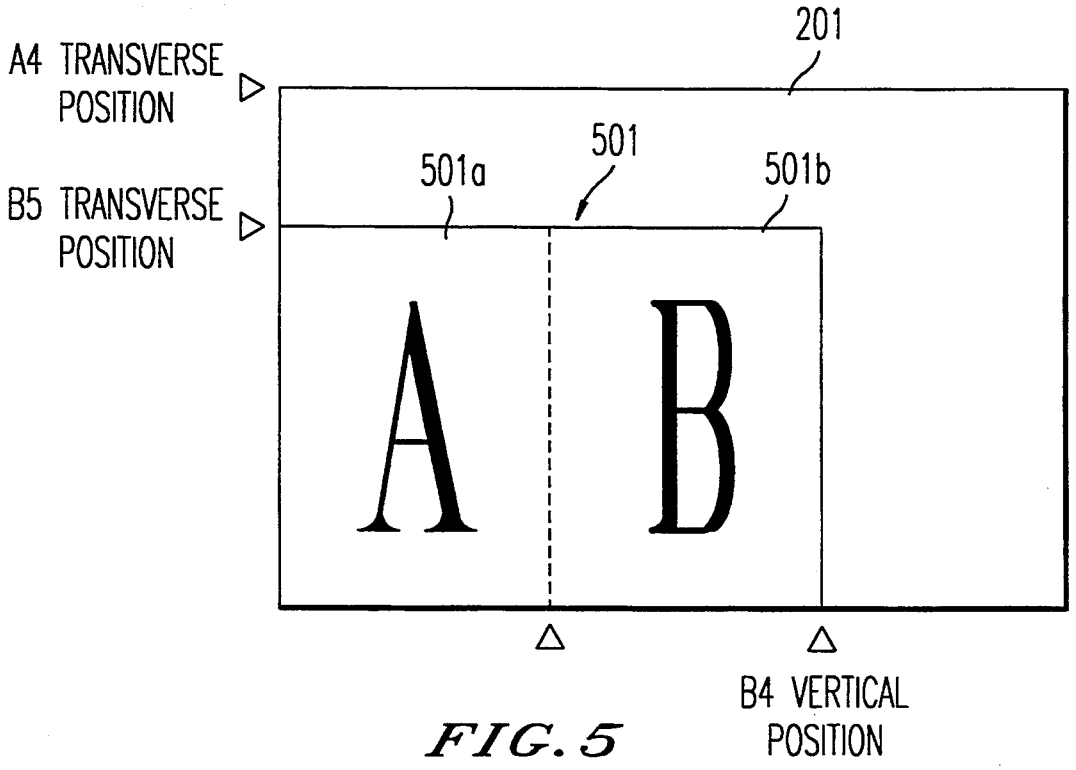
FIG. 5 is a diagram that explains the process in a case of setting a document larger in size than size A4.
Figure 6A:
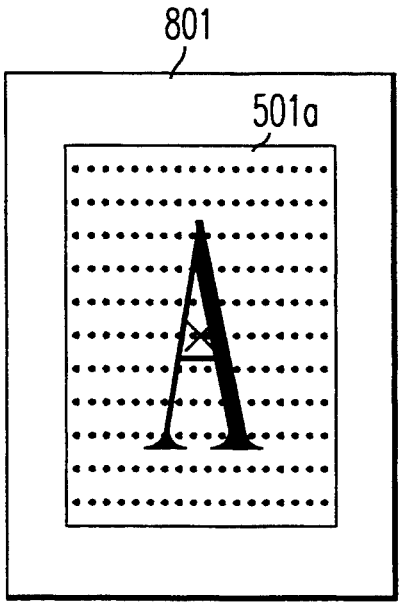
FIG. 6 is a diagram that explains the process in a case of setting a document larger in size than size A4.
Figure 6B:
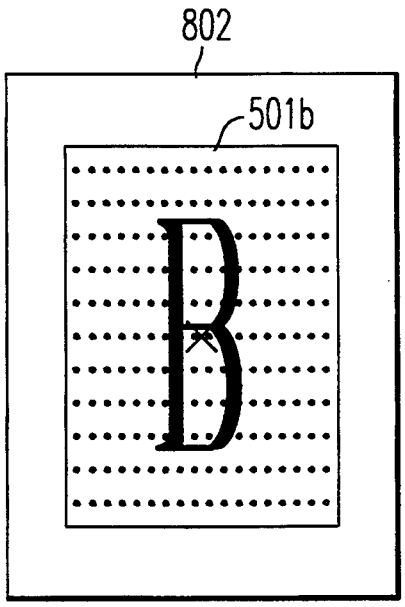

Above description assumed a case in which a document of size A4 or smaller is set had been described; and next, a case in which a document of size A4 or bigger is set will be described below. As shown in FIG. 5, when a size B4 document 501 is set on a document base 201, its size is detected by a manuscript size detecting sensor 103. Since a document base 201 is constituted to not be able to have a size B4 placed transversally, its direction is automatically recognized as in the vertical direction. Same could be said for the size A3 document.

A document 501 is consisting of a size B4 portion 501*a*, on the left, and a size B4 portion 501*b*, on the right. The whole image is read, in one scanning, by the scanning optical system 202. In case that a document is greater in size than size A4, based upon the instructions given by the controlling section 105, the following process would be operated by the image processing section 106. Namely, a document 501 is divided in two halves. These correspond to 501*a* and 501*b* of the document 501.

As in a case of a document of size B5, the image of the portion 501*a* is processed by the image processing section 106 to be recorded in the designated position of the size A4 recording paper. Likewise, the image of the portion 501*b* is processed in the same manner. These two images are recorded, in such a manner that a center of a size A4 recording paper 601*a*, and a center of a size A4 recording paper 601*b*, in FIG. 601, are approximately in accordance with a center of an image 501*a* and a center of an image 501*b*, respectively. A case of a size A3 document is processed in the same manner.

Figure 7:
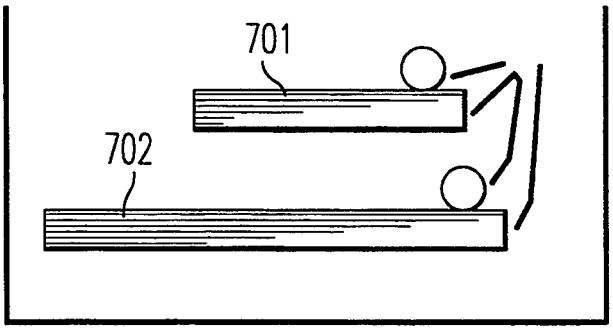
FIG. 7 is a diagram that explains the construction of the copier according to the invention.

FIG. 7 is a schematic diagram which shows the constructions of a copier according to the second embodiment. The copier of the embodiment 2 is a size A4 exclusive copier, which is constituted of two paper feeding units 701 and 702. Other portions of the construction are the same as the constructions of the embodiment 1, so description and diagrams thereof are omitted herein.

The upper paper feeding unit 701 stores size A4 transverse recording papers, while the lower paper feeding paper unit 702 stores size A4 vertical recording papers. Now it is assumed that a size B5 document is set transversely on a document base. After the process of copying is started, and the size and the direction of a document are recognized, the paper feeding unit 701, in which size A4 transverse recording papers in the direction corresponding to that of the document are stored, is automatically selected. A recording paper is fed from the paper feeding unit 701. In a case in which a size B5 vertical is set on the document base 201, the lower paper feeding unit 702 is selected. As mentioned above, a paper feeding unit, which suits the corresponding direction of the document, is selected automatically.

Figure 8:
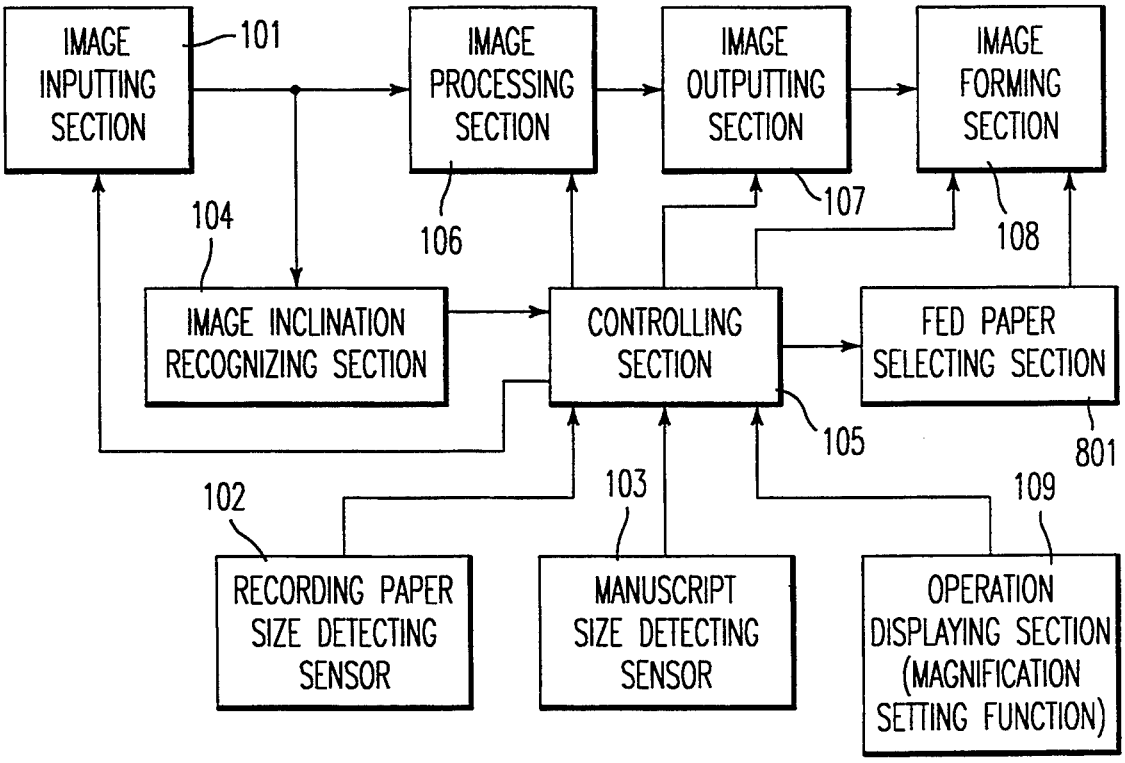
FIG. 8 is a block diagram of the copier (an image recording apparatus) according to the invention.
Figure 9A:
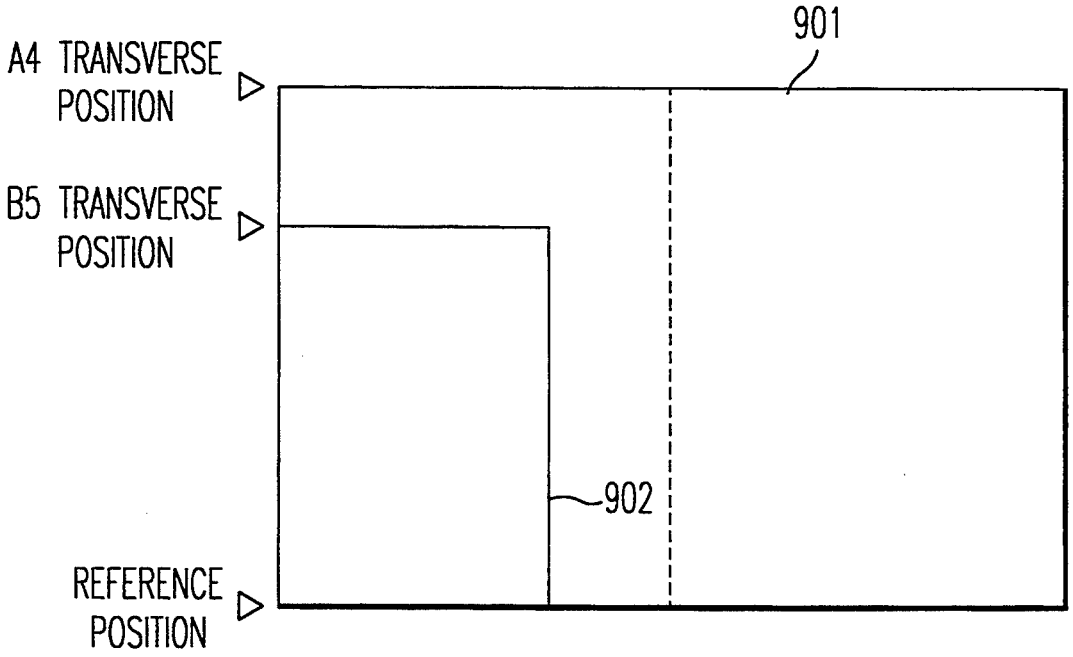
FIGS. 9A and 9B are diagrams that explain problems of the conventional image recording apparatus.
Figure 9B:
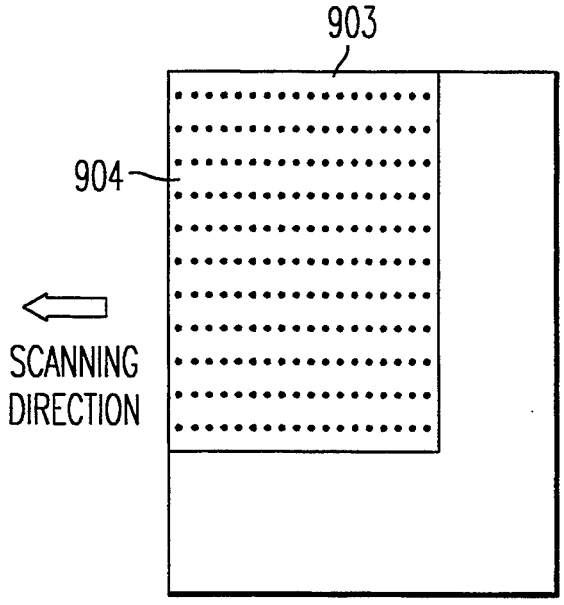
Figure 10A:
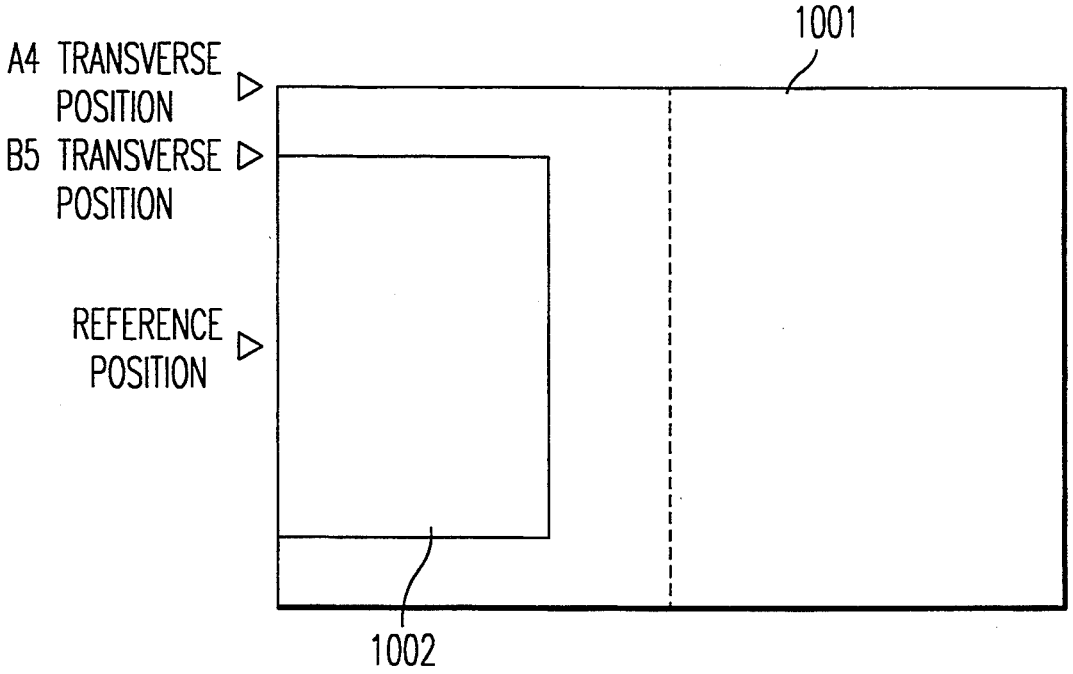
FIGS. 10A and 10B are diagrams that explain problems of the conventional image recording apparatus.
Figure 10B:
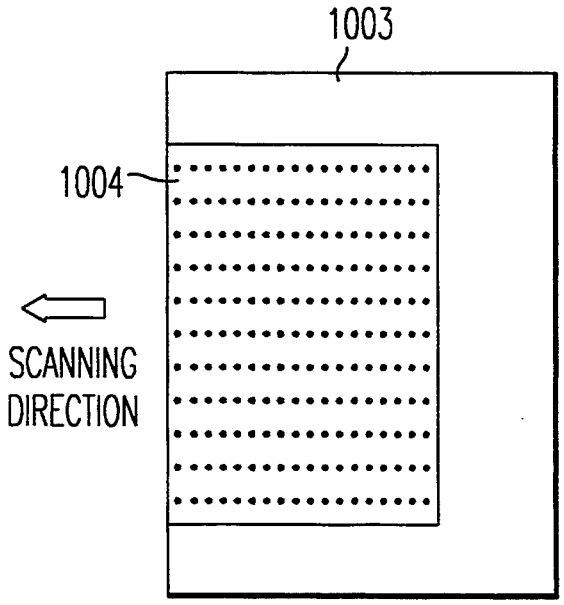

The third embodiment introduces an image recording apparatus which is, a size A4 exclusive copier having a variable magnification changing function. FIG. 8 is a block diagram of a copier according to the embodiment 3. In addition to components in the embodiment 1 (FIG. 1), the embodiment 3 has a magnification setting function, which sets enlargement/reduction mode, in the operation displaying section 109, and in addition a fed paper selecting section 801 is provided, so that when an enlargement mode is set via the magnification setting function, a recording paper of the same direction as of the document is selected. On the other hand, when a reduction mode is set, a fed paper selecting section 801, which has been added, selects a size A4 vertical recording paper. Other portions of the constructions are the same as the first embodiment illustration thereof are omitted herein.

Basically, even if the magnification is changed using a magnification setting function in the operation displaying section 109, the only size available for the recording paper is size A4. The two possible examples of copying in the mode of enlargement can be A6 to A4, and B5 to A4, while the two possible examples of copying in the mode of reduction can be A3 to A4, and B4 to A4. In the former case, the size and the direction of a document needs to be detected. In order for this detection to be done, designated magnification should be selected from the operation displaying section 109 (magnification setting function), so that A4 recording paper would be fed from a paper feeding unit. Likewise, if a copier shown in FIG. 7 is used, it could still be simply operated, in whichever direction the document is set. Especially for a case of an analog copier, it is convenient to use this type of apparatus that includes two paper feeding units, as in FIG. 7.

Meanwhile, in a case of a digital copier as shown in FIG. 2, the same operation could be done, if the copier includes an image vertical-transverse changing function. In the latter case, the direction of a document would be in the vertical direction, the reduced image would naturally be A4 length. Therefore, in this case, a fed paper selecting section 801 selects a paper feeding unit so that a recording paper of size A4 vertical would be fed.

In aforementioned embodiments 1–3, the present invention was explained using a copier as an example. Also a laser printer or a facsimile according to the present invention that installs only size A4 recording papers, an adequate image would be formed, if an image processing is operated according to the present invention in the same manner, even if the image is input on-line or off-line into the recording unit.

Furthermore, a sheetlike document is copied, using an ADF (automatic document feeding apparatus). In this case, the size of an image is detected in a known method, and employing its result, the present invention can be applied.

There are two systems for document setting of a copier including a center reference system and a corner reference system. Up to this point, a corner reference system has been explained in the preferred embodiment. In the case of a center reference system, since the center line of a document and a center line of a recording paper are aligned in relation to a reading scanning direction of the document, the only operation required is positioning in the scanning direction. However, even if an operator should displace the reference position when setting the document, the center of the document can be recognized as a result of the present invention, and an image can thereby be formed at a center of the recording paper, thereby preventing mis-copying.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image recording apparatus comprising:

an image size recognizing means which recognizes a size of an image that needs to be recorded;

a paper feeding means which stores and feeds a recording paper of designated size;

an image forming means which forms an image on said recording paper fed from said feeding means;

an image processing means which processes an image so that a center of an image that needs to be recorded and a center of said recording paper are in accordance with each other based on a recognizing result of said image size recognizing means; and an image outputting means which outputs an image processed from said image processing means to said image forming means.

2. An image recording apparatus according to claim 1, comprising an image direction recognizing means which recognizes a direction of an image that needs to be recorded, wherein said image processing means executes image processing, based on an information from said image size recognizing means executes image processing and image direction recognizing means.

3. An image recording apparatus in according to claim 2, wherein said image processing means has an image vertical-transverse changing function.

4. An image recording apparatus comprising:

an image size recognizing means which recognizes a size of an image that needs to be recorded;

a paper feeding means which stores and feeds a recording paper of designated size;

an image forming means which forms an image on said recording paper fed from said feeding means;

an image processing means which processes an image so that a center of an image that needs to be recorded and a center of said recording paper are in accordance with each other based on a recognizing result of said image size recognizing means;

an image outputting means which outputs an image processed from said image processing means to said image forming means; and an image inclination recognizing means which recognizes an inclination of an image that needs to be recorded, wherein said image processing means processes an image so that an inclination of an image that needs to be recorded and an inclination of said recording paper are in accordance with each other, based on an inclination of an image recognized by said image inclination means.

5. An image recording apparatus comprising:

an image size/direction recognizing means which recognizes a size and a direction of an image that needs to be recorded;

a first paper feeding means which stores and feeds a recording paper of designated size in a vertical direction;

a second paper feeding means which stores and feeds a recording paper of a same size, but in transverse direction, as of said first paper feeding means, based on a recognizing result of said image size/direction recognizing means;

a fed paper selecting means which selects either said first paper feeding means or said second paper feeding means, in which a recording paper of a same direction as a direction of an image is stored;

an image forming means which forms an image on a fed recording paper, based on a recognizing result of said image size/direction recognizing means;

an image processing means which processes an image so that a center of an image that needs to be recorded and a center of said recording paper are in accordance with each other; and an image outputting means which outputs an image that processed by said image processing means to said image forming means.

6. An image recording apparatus according to claim 5, wherein said image processing means executes vertical-transverse changing of an image, in a case of lacking a recording paper of a same direction as of an image.

7. An image recording apparatus comprising:

a document base on which a document is placed;

an image reading means which optically reads said document;

an image size detecting means which detects a size of an image of a document read by said image reading means;

a paper feeding means which stores and feeds a recording paper of designated size;

an image forming means which forms an image on a recording paper fed by said paper feeding means;

an image processing means which processes an image so that a center of an image that needs to be recorded and a center of said recording paper are in accordance with each other based on a detecting result of said image size detecting means, an image processing; and an image outputting means which outputs an image that processed by said image processing means to said image forming means.

8. An image recording apparatus is comprising:

an image size recognizing means which recognizes a size of an image that needs to be recorded;

a paper feeding means which stores and feeds a recording paper of designated size;

an image forming means which forms an image on said recording paper fed from said feeding means, in a case, in which a recognizing result of said image size recognizing means is greater than a size of said recording paper;

a controlling means which controls a paper feeding so that two recording papers are fed consecutively by said paper feeding means, in a case in which a recognizing result of said image size recognizing means is greater than a size of said recording paper;

an image processing means which processes an image so that an image that needs to be recorded is separated in half longitudinally, and forms an image on said recording paper fed by said paper feeding means, so that a center of an image that needs to be recorded and a center of said recording paper are in accordance with each other; and an image outputting means which outputs an image processed by said image processing means to said image forming means.

9. An image recording apparatus comprising:

a document base on which a document is placed;

an image reading means which optically reads said document;

an image size detecting means which detects a size of an image of a document read by said image reading means, a paper feeding means which stores and feeds a recording paper of designated size;

an image forming means which forms an image on said recording paper fed by said paper feeding means;

a magnification setting means which sets a mode of enlargement or reduction of said document;

a first image processing means which processes an image so that a center of an image that needs to be recorded and a center of said recording paper are in accordance with each other based on a detecting result of said image size detecting means;

a second image processing means, which performs an enlargement process or a reduction process on an image that needs to be recorded based on a mode-(enlargement or reduction) set via said magnification setting means; and an image outputting means which outputs an image processed by said first or second image processing means to said image forming means.

10. An image recording device according to claim 9, wherein, a maximum size of a recording paper is set to a predetermined size, when said magnification setting means is set to an enlargement mode.

11. The image recording device of claim 10, wherein said predetermined size is a size A4.

12. An image recording device according to claim 9, wherein, a minimum size of a recording paper is set to a predetermined size, when said magnification setting means is set to a reduction mode.

13. An image recording apparatus comprising:

a document base on which a document is placed;

an image reading means which optically reads said document;

an image size detecting means which detects a size of an image of a document read by said image reading means, a paper feeding means which stores and feeds a recording paper of designated size;

an image forming means which forms an image on said recording paper fed by said paper feeding means;

a magnification setting means which sets a mode of enlargement or reduction of said document;

a first image processing means which processes an image so that a center of an image that needs to be recorded and a center of said recording paper are in accordance with each other based on a detecting result of said image size detecting means;

a second image processing means, which performs an enlargement process or a reduction process on an image that needs to be recorded based on a mode (enlargement or reduction) set via said magnification setting means;

an image outputting means which outputs an image processed by said first or second image processing means to said image forming means; and a fed paper selecting means which selects a recording paper of a same direction as a direction of a document, in a case in which an enlargement mode is selected via said magnification setting means.

14. The image recording device of claim 12, wherein said predetermined size is a size A4.

15. An image recording apparatus comprising:

a document base on which a document is placed;

an image reading means which optically reads said document;

an image size detecting means which detects a size of an image of a document read by said image reading means, a paper feeding means which stores and feeds a recording paper of designated size;

an image forming means which forms an image on said recording paper fed by said paper feeding means;

a magnification setting means which sets a mode of enlargement or reduction of said document;

a first image processing means which processes an image so that a center of an image that needs to be recorded and a center of said recording paper are in accordance with each other based on a detecting result of said image size detecting means;

a second image processing means, which performs an enlargement process or a reduction process on an image that needs to be recorded based on a mode (enlargement or reduction) set via said magnification setting means;

an image outputting means which outputs an image processed by said first or second image processing means to said image forming means; and a fed paper selecting means which selects a predetermined size vertical recording paper, in a case that a reduction mode is set via said magnification setting means.

16. The image recording device of claim 15, wherein said predetermined size is a size A4.

17. An image recording apparatus comprising:

an image size/direction recognizing means which recognizes a size and a direction of an image that needs to be recorded;

a first paper feeder which stores and feeds a recording paper of designated size in a vertical direction;

a second paper feeder which stores and feeds a recording paper of a same size, but in a transverse direction, as said first paper feeder, based on a recognizing result of said image size/direction recognizing means;

a fed paper selecting means which selects either said first paper feeder or said second paper feeder, in which a recording paper of a same direction as a direction of an image is stored;

an image forming means which forms an image on a fed recording paper, based on a recognizing result of said image size/direction recognizing means so that a center of an image that needs to be recorded and a center of said recording paper are in accordance with each other.

18. An image recording apparatus comprising:

an image size recognizing means which recognizes a size of an image that needs to be recorded;

a paper feeder which stores and feeds a recording paper of designated size;

an image forming means which forms an image on said recording paper fed from said feeding means, in a case in which a recognizing result of said image size recognizing means is greater than a size of said recording paper;

a controlling means which controls a paper feeding so that two recording papers are fed consecutively by said paper feeder, in a case in which a recognizing result of said image size recognizing means is greater than a size of said recording paper;

an image processing means which processes an image so that an image that needs to be recorded is separated in half longitudinally, and forms an image on said recording paper fed by said paper feeder; and an image outputting means which outputs an image processed by said image processing means to said image forming means.

19. An image recording method comprising:

recognizing a size and direction of an image to be recorded;

providing a first paper feeding means which stores and feeds a recording paper of a designated size in a vertical direction;

providing a second paper feeding means which stores and feeds a recording paper of a same size, but in a transverse direction, as said first paper feeding means, based upon a recognizing result of said image size and direction recognizing step;

selecting either said first paper feeding means or said second paper feeding means in which a recording paper of a same direction as a direction of an image is stored;

forming an image on the fed recording paper based upon a recognizing result of said image size and direction recognizing step;

wherein the step of forming an image includes processing the image so that a center of the image to be recorded and a center of the recording paper are coordinated with each other, and outputting the processed image to an image forming means which forms the image on the fed recording paper.

20. An image forming method comprising:

recognizing a size of an image to be recorded;

feeding a recording paper of a designated size;

forming an image on fed recording paper when a recognizing result of said image size recognizing step is greater than a size of said recording paper;

controlling paper feeding such that two recording papers are fed consecutively in said paper feeding step when a recognizing result of the image size recognizing step is greater than a size of said recording paper; and wherein the step of forming an image includes processing an image to record an image separated in half longitudinally, to form an image on recording paper fed in said paper feeding step, such that a center of an image to be recorded and a center of said recording paper are coordinated with each other, and outputting the processed image to an image forming means which forms the image on said recording paper.

* * * * *